US005363518A

United States Patent [19]

Mowery

[11] Patent Number: 5,363,518

[45] Date of Patent: Nov. 15, 1994

[54] POPUP DRAIN STOPPER

[75] Inventor: Richard W. Mowery, Long Beach, Calif.

[73] Assignee: Emhart Inc., Newark, Del.

[21] Appl. No.: 843,778

[22] Filed: Feb. 28, 1992

[51] Int. Cl.[5] ..... A47K 1/14; E03C 1/23

[52] U.S. Cl. ..... 4/692; 4/688; 4/295; 137/375; 251/339

[58] Field of Search ..... 4/286, 295, 690, 691, 4/692, 684, 685, 682, 683, 688, 689; 137/375; 251/319, 339

[56] References Cited

U.S. PATENT DOCUMENTS

| | | | |
|---|---|---|---|
| 425,113 | 4/1890 | Susemihl | 4/295 |
| 1,428,228 | 9/1922 | Grover | 4/293 |
| 1,597,459 | 8/1926 | Muend | 4/691 |
| 1,937,609 | 12/1933 | Tompkins | 222/499 |
| 2,493,362 | 1/1950 | Rocker | 4/237 |
| 2,540,620 | 2/1951 | Hyde | 4/237 |
| 3,646,619 | 3/1972 | Rokitenetz | 4/692 |
| 4,160,293 | 7/1979 | Niemann | 4/291 |
| 4,381,569 | 5/1983 | Ingram | 4/295 |
| 4,807,306 | 2/1989 | Hayman et al. | 4/692 |
| 4,908,883 | 3/1990 | Rivera | 4/295 |

FOREIGN PATENT DOCUMENTS

| | | | |
|---|---|---|---|
| 2900812 | 3/1980 | Germany | 4/286 |
| 2842490 | 4/1980 | Germany | 4/286 |

*Primary Examiner*—Robert M. Fetsuga
*Attorney, Agent, or Firm*—J. Bruce Hoofnagle

[57] ABSTRACT

A plunger assembly 42, which functions as a popup drain stopper, includes a one-piece plastic body 44 formed with a head 50 at an upper end thereof. A connector 48 is formed at a lower end of body 44. A dome-shaped decorative cap 52 is removably assembled at the upper end of head 50 and is supported by a dome-shaped structural grid 77 formed in the head. Projections 80 extend radially from head 50 and cooperate with an inwardly flared side wall 86 of cap 52 to retain the cap with the head and body 44. Assembly 42 is positioned within a drain assembly 12 which is coupled to a basin 10. Assembly 42 is controlled for movement by lever 62 to raise and lower head 50 relative to a drain opening 27. Head 50 seals opening 27 with a seal washer 56 in a lower position and allows water to flow from the basin in an upper position.

10 Claims, 2 Drawing Sheets

POPUP DRAIN STOPPER

BACKGROUND OF THE INVENTION

This invention relates to a popup drain stopper and particularly relates to a popup drain stopper used with a lavatory basin or sink to control the collection of water in the basin and the draining of water therefrom.

Popup drain stopper assemblies for lavatory basins have been in use for some time. For example, as described and illustrated in U.S. Pat. No. 3,646,619, which issued on Mar. 7, 1972, a popup stopper assembly includes a plunger which is formed with an offset connector at its lower end. The offset connector is cooperable with the end of a ball-mounted lever to move the plunger vertically within a plunger casing. A plunger cap is threadedly attached to the top of the plunger to form a plunger- cap assembly. The cap supports an O-ring which seats within a drain opening of a drain sleeve through which water drains from the basin.

The popup drain stopper assembly is movable vertically by operation of the ball-mounted lever from a location external of the plunger casing. In a closed position, the plunger is moved downwardly so that the cap at the top of the plunger is located within the drain opening of the drain sleeve whereby the O-ring seats within the opening to thereby seal the opening and preclude water from draining from the basin. In an open position, the plunger is raised to move the cap above and out of the drain opening of the drain sleeve whereby any water in the basin is allowed to pass through the drain sleeve to drain the water therefrom.

The drain sleeve is formed with an annular flange which extends radially outwardly from the drain opening and seats in an opening formed in the basin. Thus, both the cap and the flange are exposed at all times and are subject to tarnishing. At times, it may be desirable to replace the plunger-cap assembly by use of an inexpensive process. However, the new cap will have been surface treated and will present a distinctly newer and cleaner surface than the surface of the adjacent flange at the bottom of the basin. In order to avoid such a distasteful appearance, the drain sleeve would have to be replaced which could result in an expensive process.

Also, the plunger-cap assembly is formed from two elements, the plunger and the cap. The plunger is formed from a plastic material which must be formed with a threaded stud at the cap end. Further, the cap is a metallic element which is formed with an annular groove for supporting the O-ring and a threaded opening for receipt of the threaded stud of the plunger. Further, at least the portion of the cap which is outwardly exposed within the basin must be surface treated in the same manner as the flange for appearance purposes. Thus, several time consuming and costly manufacturing operations are required to make the plunger-cap assembly.

Another type of plunger assembly includes a head which is located in the basin and is a part of the plunger assembly which extends into a drain assembly. A cap is assembled in permanent fashion to the head by crimping, for example, the edges of the cap around the underside of the head. With this type of assembly, the cap cannot be removed separately. Therefore, at least the entire plunger assembly would have to be replaced if it is desired to replace the cap.

Therefore, there is a need for a drain stopper assembly which is less costly and easier to manufacture while maintaining the structural and aesthetic integrity of the stopper assembly, and providing for easy replacement of at least the visible components thereof.

SUMMARY OF THE INVENTION

In light of the need expressed above, it is an object of this invention to provide a popup drain stopper which is relatively inexpensive to manufacture.

Another object of this invention is to provide a popup drain stopper which has relatively fewer parts which are easily assembled and replaceable.

With these and other objects in mind, the present invention contemplates a popup drain stopper which includes a plunger having a head formed at one end thereof and a connector at the other end thereof. The connector of the plunger is attachable to a lever mechanism which can be manipulated to raise or lower the plunger. A removable cover is positionable on the head of the plunger and is held in place by means for removably retaining the cover with the plunger.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
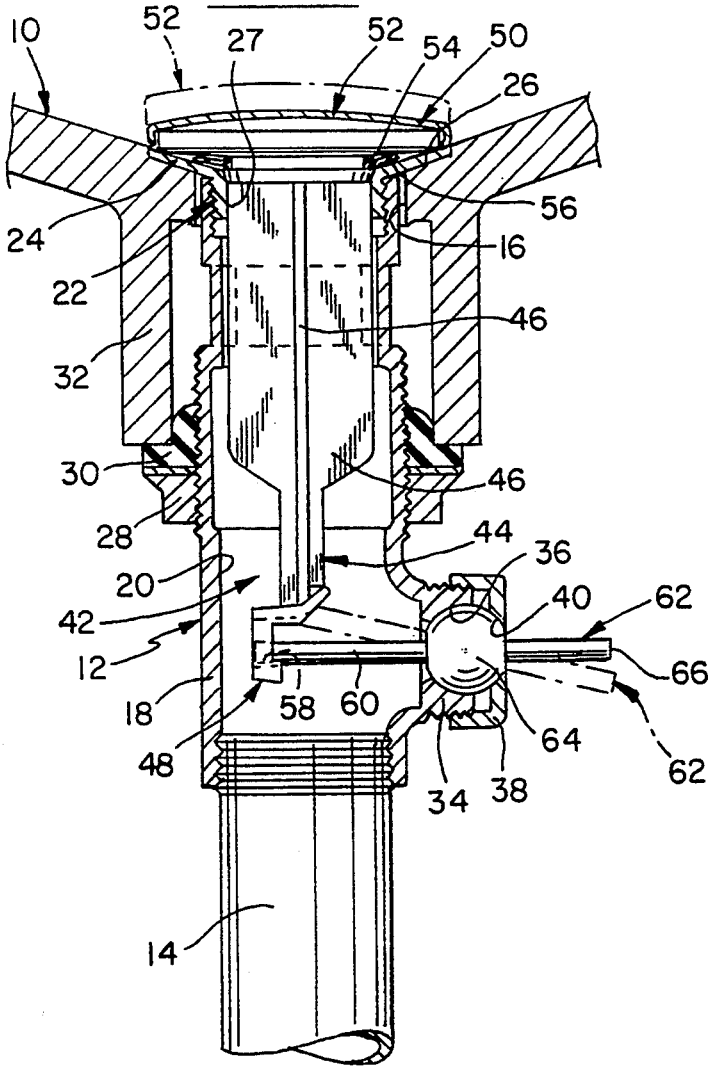
FIG. 1 is a side sectional view showing a popup drain stopper in accordance with certain principles of the invention.

Referring to FIG. 1, a sink or basin 10 is assembled with a drain assembly 12 which, in turn, is coupled to a drain pipe 14. Basin 10 is formed with an opening 16 at the base thereof. Drain assembly 12 includes a cylinder-like housing 18 which has a central opening 20 and which is made of cast brass or the like. A drain sleeve 22 having a flange 24 is threadedly attached to the upper end of housing 18 with the flange extending into a recessed ledge 26 surrounding opening 16 in the base of basin 10. Drain sleeve 22 is formed with a central opening 27 that communicates with central opening 20 of housing 18 and provides a drain passage for water in basin 10. A lock nut 28 is positioned threadedly on a threaded exterior of housing 18 and, together with drain sleeve 22, secures drain assembly 12 with basin 10. A resilient washer 30 is located between lock nut 28 and a downwardly extended portion 32 of basin 10.

Housing 18 is formed with an externally threaded projection 34 having a spherical-walled passage 36 therethrough. A capnut 38 is threadedly positionable on the externally threaded projection 34 and is formed with an opening to which also has a spherical wall.

A plunger assembly 42, which functions as a popup drain stopper, is located within opening 20 of housing 18 and includes a one-piece plunger body 44 (FIGS. 1 and 2) composed of a suitable plastic material. The intermediate portion of body 44 is formed with a plurality of guide vanes 46 and a connector 48 at the lower end thereof. The upper end of body 44 is formed with a head 50 which is designed to support a decorative cap 52 as a component of the plunger assembly 42. Body 44 is formed with an annular recess 54 adjacent the underside of head 50 and provides facility for the assembly of a seal washer 56 with the body for movement therewith.

Connector 48 of body 44 is formed with an opening 58 which is offset from, and has an axis perpendicular with, the axis 59 (FIG. 2) of the body. One section 60 of a lever rod 62 extends from one side a swivel ball 64 and is inserted into opening 58 at the extreme end of section 60. Another section 66 of lever rod 62 extends from an opposite side of swivel ball 64.

Capnut 38 is removed to allow assembly of lever rod 62 and swivel ball 64 with housing 18. The extreme end of section 60 of lever rod 62 is moved through passage 36 of projection 34 and into opening 58 of connector 48 of body 44. Capnut 38 is threadedly attached to projection 34 so that swivel ball 64 is captured in the assembled arrangement.

Ball 64 can now be swivelled within its captured arrangement to move lever rod 62 to the position shown in phantom. In this manner, plunger assembly 42 is moved upwardly to position head 50 and cap 52 to the position illustrated in phantom in FIG. 1. When lever rod 62 is manipulated to move plunger assembly 42 to the position illustrated in solid in FIG. 1, seal washer 56 is sandwiched between the underside of head 50 and the exposed upper surface of flange 24 of drain sleeve 22. In this manner, any water which is deposited into basin 10 will be precluded from flowing from the basin, through sleeve opening 27 and housing opening 20 and into pipe 14 by virtue of the sealing action of seal washer 56.

Figure 2:
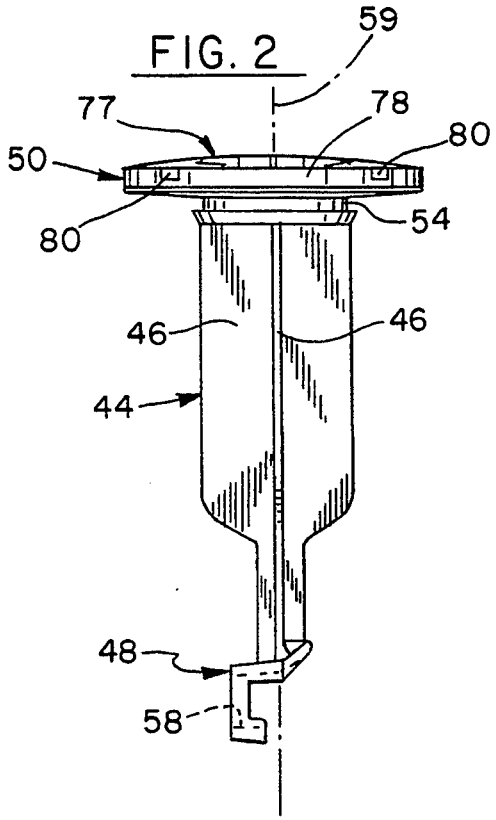
FIG. 2 is a side view of a plunger with a head at one end and a connector at another end in accordance with certain principles of the invention.
Figure 3:
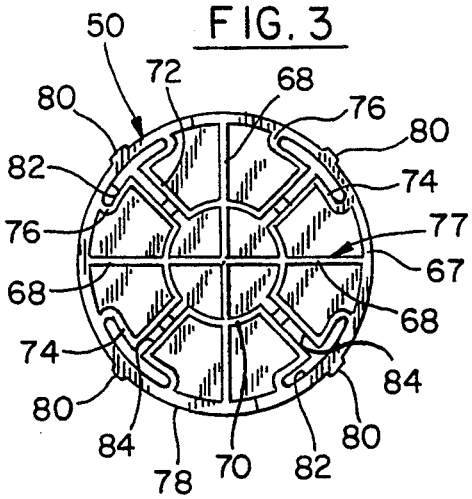
FIG. 3 is a plan view of the head showing features thereof in accordance with certain principles of the invention.

Referring to FIGS. 2 and 3, head 50 of body 44 is formed with a relatively wide edge rib 67 which is concentric about the axis of the body and which projects upwardly as viewed in FIG. 2. Head 50 is also formed with a pair of cross ribs 68 which extend diametrically from one side of the head to the other and which join integrally with edge rib 67. As shown in FIG. 2, cross ribs 68 curve upwardly from one side of head 50 to the center or axis of body 44 and then curve downwardly to the other side of the head. As shown in FIG. 3, a circular rib 70 is located concentrically about the axis of body 44 and joins cross ribs 68 at junctures of the cross ribs with the circular rib. Four pairs of radial ribs 72 are joined integrally with and extend radially outwardly from circular rib 70 with the ribs of each pair being spaced from each other. Ribs 72 are joined with lateral ribs 74 which extend in parallel with spaced but adjacent portions of edge rib 67 for a short distance and then join integrally with linking ribs 76 which extend a short distance and link integrally with edge rib 67.

Ribs 70, 72, 74 and 76 are curved upwardly as viewed in FIG. 2 as these ribs extend away from edge rib 67 toward the center or axis of body 44. In this manner, ribs 70, 72, 74 and 76 follow the contour of cross ribs 68 and, together with edge rib 67, combine to provide a structural grid 77 and undersupport for cap 52 in a dome-like fashion.

Head 50 is also formed with a peripheral wall 78 and four projections 80 which extend radially outwardly from the peripheral wall. Also, the four areas illustrated in FIG. 3 which are enclosed by the four sets of edge rib 67, lateral ribs 74 and linking ribs 76 are formed with four holes 82 which extend through head 50 in a direction parallel to the longitudinal axis 59 (FIG. 2) of body 44. Also, holes 82 communicate with holes 84 which extend radially a short distance toward the center of head 50, as viewed in FIG. 3, between respective sets of adjacent radial ribs 72. Further, each of projections 80 are located radially outwardly and centrally of a respective one of the holes 82.

On occasion, condensation may collect on the underside of cap 52 and drain into the top of head 50. Holes 84 are situated to allow such condensation to drain through the openings and deposit beneath the head and eventually pass through opening 20 (FIG. 1) of housing 18.

Figure 5:
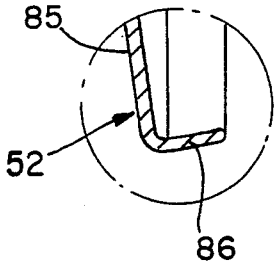
FIG. 5 is a sectional view taken along line 5—5 of FIG. 4 showing a portion of the cap of FIG. 4 in accordance with certain principles of the invention.
Figure 4:
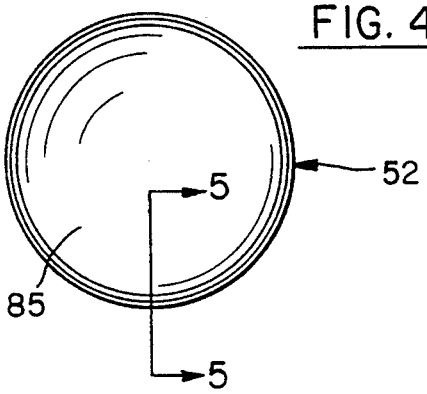
FIG. 4 is a plan view of a removable cap.
Figure 6:
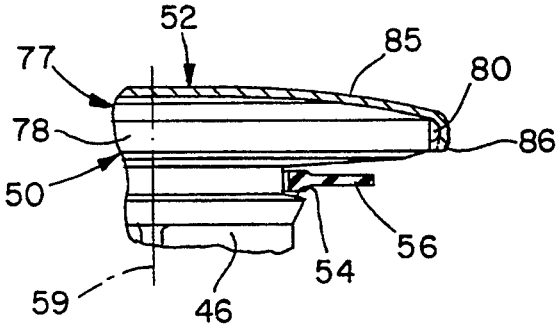
FIG. 6 is a partial side view of the head of the plunger in assembly with the cap, shown in sectional view, and with a seal washer in place about the plunger, all in accordance with certain principles of the invention.

Decorative cap 52, which is formed from metal such as, for example, brass is blanked and formed from a strip into the shape as illustrated in FIGS. 4, 5 and 6. In particular, cap 52 has a circular top 85 as viewed in FIG. 4, is dome shaped as viewed in FIGS. 1 and 6 and has a downwardly turned side wall 86. Side wall 86 is flared inwardly around its entire circumference as shown particularly in FIG. 5 and also illustrated in FIGS. 1 and 6. After blanking, cap 52 is then suitably surface treated, at least on the exterior surfaces, for aesthetic and wear-treatment purposes.

In assembly, cap 52 is placed over the structural grid 77 so that the lower edges of side wall 86 engage projections 80 whereby the side wall is cammed slightly outwardly and portions of edge rib 67 are flexed radially inwardly due to the location of holes 82. This allows cap 52 to be moved into engagement over structural grid 77 to a final position as illustrated in FIG. 6. In this final position, the lower portions of side wall 86 have cleared projections 80 and are now allowed to return to the inwardly flared state while the projections again project outwardly to return to their normal state. In this manner, as clearly shown in FIG. 6, side wall 86 is located around projections 80 to thereby facilitate retentions of cap 52 with head 50. It is noted that cap 52 can be removed from assembly with head 50 in a reverse process by simply urging the edge of side wall 86 upwardly to flex projections 80 inwardly and the side wall slightly outwardly. In this manner, cap 52 can be replaced with a new cap of the same or a different finish as desired.

Thus, as described above, plunger assembly 42 includes one-piece body 44 which is formed with head 50 and annular recess 54. Decorative cap 52 is easily assembled with head 50 to provide a decorative and wear-treated surface as viewed by one viewing and/or using basin 10. Further, cap 52 is easily disassembled to facilitate replacement thereof with another cap of a selected finish. This allows a customer-user to replace tarnished caps or to install caps having a different finish for decorative purposes.

Further, the dome shaped configuration of structural grid 77 provides substantial support for cap 52 and the dome configuration thereof.

Still further, the location of holes 82 radially inwardly of projections 80 allow the flexing of portions of edge rib 67 adjacent the projections during the period when cap 52 is being assembled, or disassembled, with head 50 and side wall 86 is being moved over the projections.

Also, head 50 and cap 52 are sufficiently large in diameter to cover flange 24 of drain sleeve 22. If the popup drain stopper, as disclosed herein, is used as a replacement for an older in-place stopper, the flange of the drain sleeve of the older unit may be tarnished from past use. However, since head 50 and cap 52 cover the flange of the older unit, the drain sleeve need not be replaced thereby eliminating a costly replacement and installation process.

In general, the above-described embodiment is not to be construed as limiting the breadth of the present invention. Modifications and other alternative constructions will be apparent which are within the spirit and scope of the invention as defined in the appended claims.

What is claimed is:

1. A popup drain stopper for assembly with a basin, a drain assembly and a drain opening common to the basin and drain assembly, which comprises:

a one-piece plunger body having a first end and a second end;

a connector formed in the body at the first end thereof;

a head formed in the body at the second end thereof;

the head being formed with holes to allow condensation which may form in a space between the head and the cap to drain from the space;

a removable cap positioned on the head;

means for removably retaining the cap with the head; and sealing means assembled with the body adjacent the head for sealing the drain opening, whereby the plunger body can be assembled within the drain assembly with the head located within the basin and with the connector attached to an operating mechanism to lower the plunger body to a lowermost position and locate the sealing means to seal the drain opening and to raise the plunger body to allow the drain opening to be unsealed.

2. The popup drain stopper as set forth in claim 1 wherein the retaining means includes projections which extend from the head.

3. The popup drain stopper as set forth in claim 1 wherein the retaining means comprises:

the cap being formed with a top having a central axis;

a side wall formed integrally with outer edges of the top; and the side wall having at least a portion which flares inwardly toward the central axis of the top.

4. The popup drain stopper as set forth in claim 1 wherein the retaining means comprises:

projections extending outwardly from the head;

the cap formed with a top having a central axis;

a side wall formed integrally with outer edges of the top; and the side wall having at least a portion which flares inwardly toward the central axis of the top so that the projections are captured between the head and the flared side wall to facilitate retention of the cap with the head.

5. The popup drain stopper as set forth in claim 1, which further comprises:

the cap being formed with a top portion which is assembled with a top portion of the head; and the top portion of the head being formed with the structural grid which supports the top of the cap when assembled with the head.

6. The popup drain stopper as set forth in claim 5 wherein the top of the cap is dome shaped and the structural grid is dome shaped in complementary fashion to provide conforming support for the cap.

7. The popup drain stopper as set forth in claim 5 wherein the structural grid is formed by an integral rib network which extends outwardly at top end of the head.

8. The popup drain stopper as set forth in claim 1 wherein the drain assembly includes a flange which has an exposed surface within the basin and which extends radially outwardly of the drain opening, and which further comprises:

the head and the cap being of sufficient size to overlap and cover the entire exposed surface of the flange within the basin.

9. The popup drain stopper as set forth in claim 8 wherein the sealing means is located between the head and the flange when the plunger body is located in the lowermost position to thereby seal the drain opening.

10. A popup drain stopper for assembly with a basin, a drain assembly and a drain opening common to the basin and drain assembly, which comprises:

a one-piece plunger body having a first end and a second end;

a connector formed in the body at the first end thereof;

a head formed in the body at the second end thereof;

a removable cap positioned on the head;

means for removably retaining the cap with the head;

the retaining means including:

projections extending outwardly from the head;

the cap formed with a top having a central axis;

a side wall formed integrally with outer edges of the top;

the side wall having at least a portion which flares inwardly toward the central axis of the top so that the projections are captured between the head and the flared side wall portion to facilitate retention of the cap with the head; and holes formed in the head inwardly of and adjacent the projections to allow those portions of the head to flex inwardly as the cap is being assembled with the head; and sealing means assembled with the body adjacent the head for sealing the drain opening, whereby the plunger body can be assembled within the drain assembly with the head located within the basin and with the connector attached to an operating mechanism to lower the plunger body to a lowermost position and locate the sealing means to seal the drain opening and to raise the plunger body to allow the drain opening to be unsealed.

* * * * *